US007344182B1

(12) United States Patent
Weddell et al.

(10) Patent No.: US 7,344,182 B1
(45) Date of Patent: Mar. 18, 2008

(54) MODULAR ROOF MOUNT AWNING SYSTEM

(75) Inventors: Vince Weddell, San Clemente, CA (US); Robert G. Heitel, Laguna Beach, CA (US)

(73) Assignee: Girard Systems, San Clemente, CA (US)

( * ) Notice: Subject to any disclaimer, the term of this patent is extended or adjusted under 35 U.S.C. 154(b) by 0 days.

(21) Appl. No.: 11/602,132

(22) Filed: Nov. 20, 2006

(51) Int. Cl.
*B60R 15/00* (2006.01)

(52) U.S. Cl. ..... 296/163; 160/67; 160/70

(58) Field of Classification Search ..... 296/163; 160/67, 22, 66, 70; 135/88.12, 903, 117; 52/74

See application file for complete search history.

(56) References Cited

U.S. PATENT DOCUMENTS 2,423,402 A * 7/1947 Olsen ..... 160/46
3,934,924 A * 1/1976 Diliberti ..... 296/163
3,952,758 A * 4/1976 Addison et al. ..... 135/903
4,869,194 A * 9/1989 Cummins ..... 114/344
5,119,867 A * 6/1992 Lukos ..... 160/70
5,368,056 A * 11/1994 Riggi, Jr. ..... 160/67
5,558,145 A * 9/1996 Baka ..... 160/67
5,636,675 A * 6/1997 Baka et al. ..... 160/67
5,823,216 A * 10/1998 Simonetti ..... 135/88.12
6,123,136 A * 9/2000 Williams ..... 160/67
6,152,516 A * 11/2000 Williams ..... 296/98
6,598,612 B1 * 7/2003 Crowe ..... 160/67
6,782,936 B1 8/2004 Girard et al.
2007/0193700 A1 * 8/2007 Ornelas et al. ..... 160/70

* cited by examiner

*Primary Examiner*—Kiran B. Patel
(74) *Attorney, Agent, or Firm*—Walter A. Hackler

(57) ABSTRACT

A vehicle awning system includes a plurality of arm supports disposable in a spaced apart relationship on a vehicle roof with each support having a cantilevered portion disposable in a spaced apart relationship with the vehicle roof. A roller is disposed between the cantilevered portion and the vehicle roof and a fabric having a topside and a bottom side is wound on the roller and extendable therefrom with a lead rail. A plurality of articulated arms interconnect a corresponding arm support with the lead rail and are disposed over the fabric topside for tensioning the fabric between the roller and the lead rail.

8 Claims, 3 Drawing Sheets

MODULAR ROOF MOUNT AWNING SYSTEM

The present invention generally relates to awnings and more particularly relates to retractable, self-storing awnings suitable for use on vehicles.

Heretofore, numerous retractable vehicle awnings have been stored within a box, or casing, attached a side of the vehicle. This requires a frame to be attached to the side of the vehicle which can be a cumbersome attachment depending upon the size of the deployable awning. It also should be appreciated that the streamline configuration of the vehicle is diminished as well as the overall appearance through the use of such sidewall mounted awnings.

The present invention provides for a modular roof mount awning system which can span the entire length of a coach without interruption of awning coverage. This allows a cleaner retracted look while providing more area of coverage.

SUMMARY OF THE INVENTION

A vehicle awning system in accordance with the present invention includes a plurality of first arm supports which are disposable in a spaced apart relationship on a vehicle roof. Each support has a cantilevered portion disposable in a spaced apart relationship with the vehicle roof. This arrangement provides better mechanical attachment to the roof and easily allows for custom adjustments in multiple angles, such as for example, pitch, yaw, rotation, and translation.

A first roller disposed between the cantilevered portion and the roof vehicle and a first fabric having a topside and bottom side is wound on the roller and extendable therefrom with an end attached to a lead rail.

A plurality of first articulated arms interconnects a corresponding arm support with the lead rail and is disposed over the fabric topside for tensioning the fabric between the roller and the lead rail. Thus, the supporting arms are on a topside of the fabric as opposed to prior art awnings which include arms disposed beneath the fabric. Accordingly, the supporting arm structure in accordance with the present invention is not visible to the awning user.

Preferably, the present invention further includes a fabric support tray disposed under the roller along with a bottom fabric brush attached thereto for removing debris or smoothing of a fabric.

In addition, a top brush may be also provided for sweeping a topside of the fabric and also for smoothing of the fabric as it is rolled.

A cover may be provided to enclose the arm supports roller and in addition an aerodynamic fairing may be disposed on ends of the cover to reduce wind drag when the vehicle is in motion and also stylize the awning system.

The awning system in accordance with the present invention also may provide for a cover roller and fabric having a length approximately equal to the vehicle roof length and in addition a valance may be deployable from the lead rail.

The awning system may include second arm supports, second rollers, second lead rails, and second fabrics disposed on an opposite side of a vehicle roof and configured in the same manner, as hereinabove described. In this embodiment, a fairing may be provided interconnecting ends of the covers.

BRIEF DESCRIPTION OF THE DRAWINGS

The present invention may be more clearly understood with reference to the following detailed description, in connection with the appended drawings, in which.

DETAILED DESCRIPTION

Figure 1:
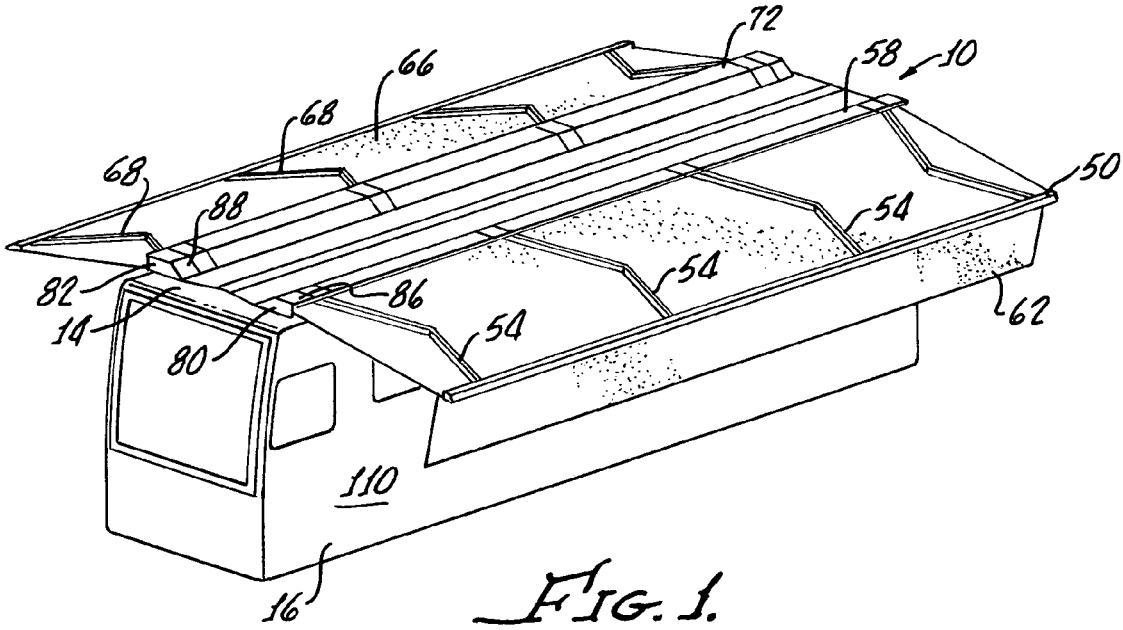
FIG. 1 is an isometric view of the awning system in accordance with the present invention illustrating a continuous length fabric awning on a vehicle top and extending over both sides of a recreational vehicle and also showing a deployable valance and articulated arms disposed over a fabric topside.
Figure 2:
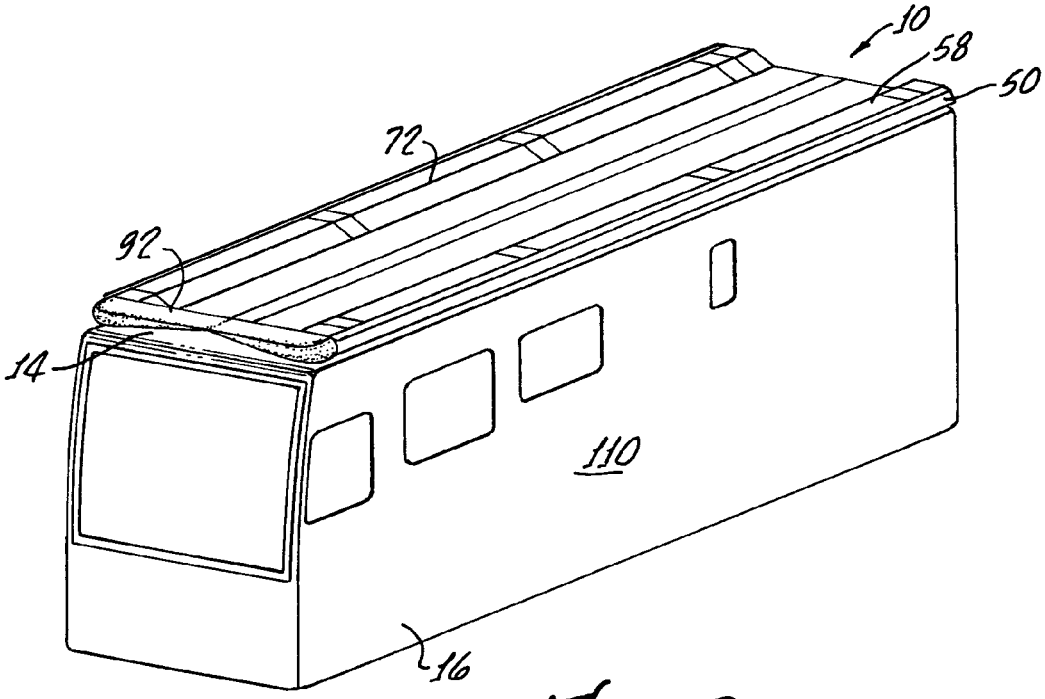
FIG. 2 is similar to the view shown in FIG. 1 but with the awnings being retracted.
Figure 3:
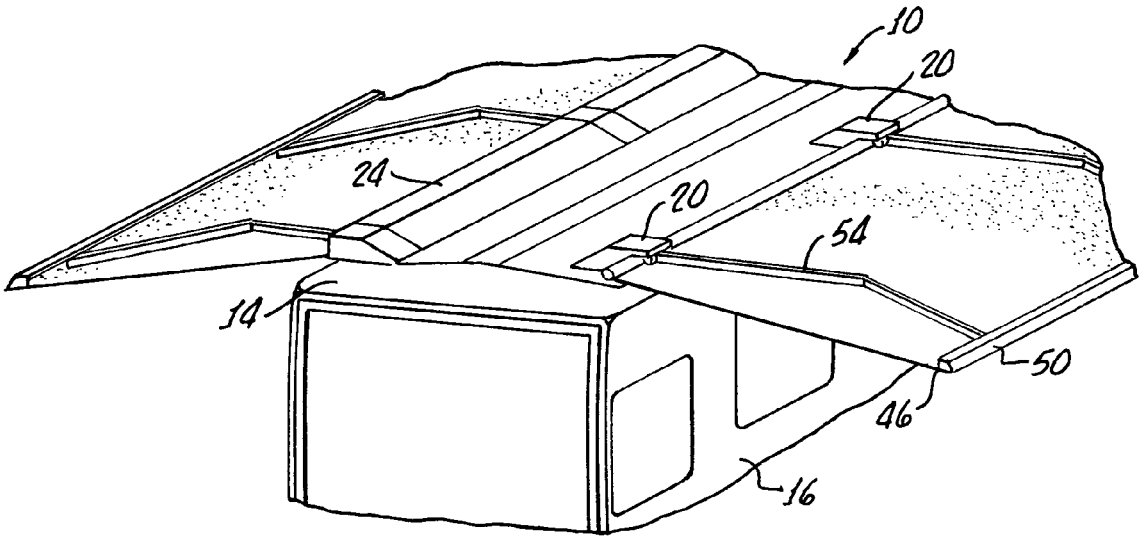
FIG. 3 is a view similar to FIG. 1 with a cover removed illustrating arm supports disposed on the vehicle roof.

With reference to FIGS. 1-3 there is shown a vehicle awning system 10 in accordance with the present invention as it may be installed on a roof 14 of a recreational vehicle 16.

More particularly, as illustrated in FIG. 3, the system 10 includes a plurality first arm supports disposable in a spaced apart relationship on the vehicle roof 14. A second set of identical arm supports (not shown) are disposed opposing the first arm supports 20 on the roof 14 under a cover 24. Specific description and illustration thereof not being repeated in view of the structure and function thereof being identical to the arm supports 20.

Figure 4:
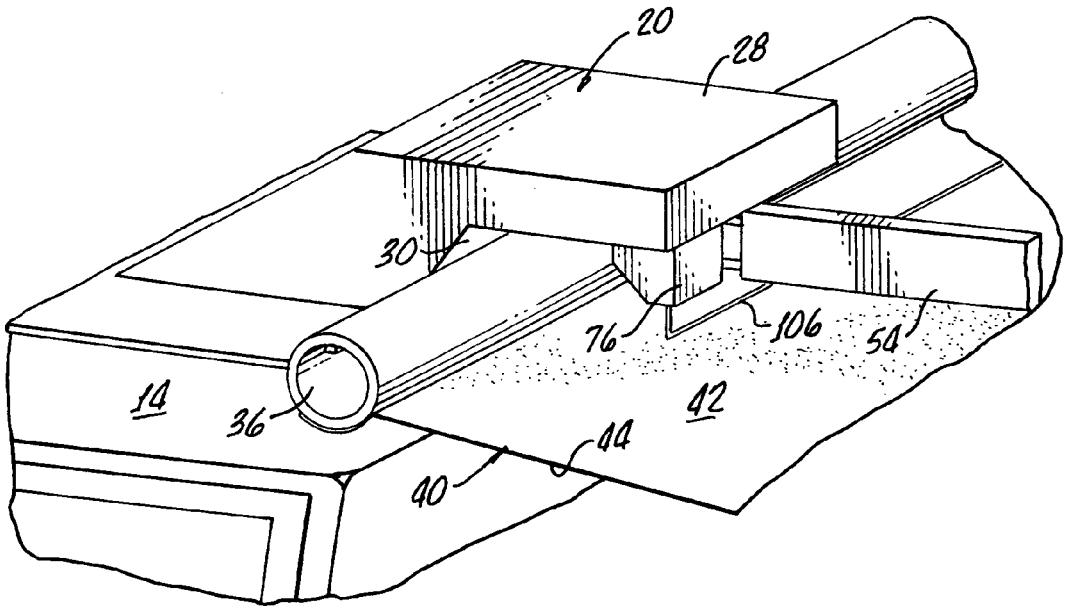
FIG. 4 is an enlarged view of the arm support mechanism and bracket for attaching to the vehicle roof along with a roller and fabric disposed therearound.

As more clearly shown in FIG. 4, each of the supports 20 include a cantilevered portion 28 disposed in a spaced apart relationship with the vehicle roof 14 thus providing a gap 30 therebetween. Use of individual supports 20 eliminates the conventional "box" extrusion utilized on current, preassembled awnings and therefore provides for a considerably lower weight for a given awning area. An additional advantage is the fact that final assembly is done "on location" on the vehicle rather than shipping an entire box awning for attachment to the vehicle. This results in less freight damage. Further, the supports have a much lower vertical profile than conventional awnings, and as hereinbefore noted, the system is entirely roof mounted thus keeping the side of the vehicle clean and more streamlined. In addition, the supports allow for custom adjustments and multiple angles, either in pitch, yaw, rotation, or translation.

Figure 5:
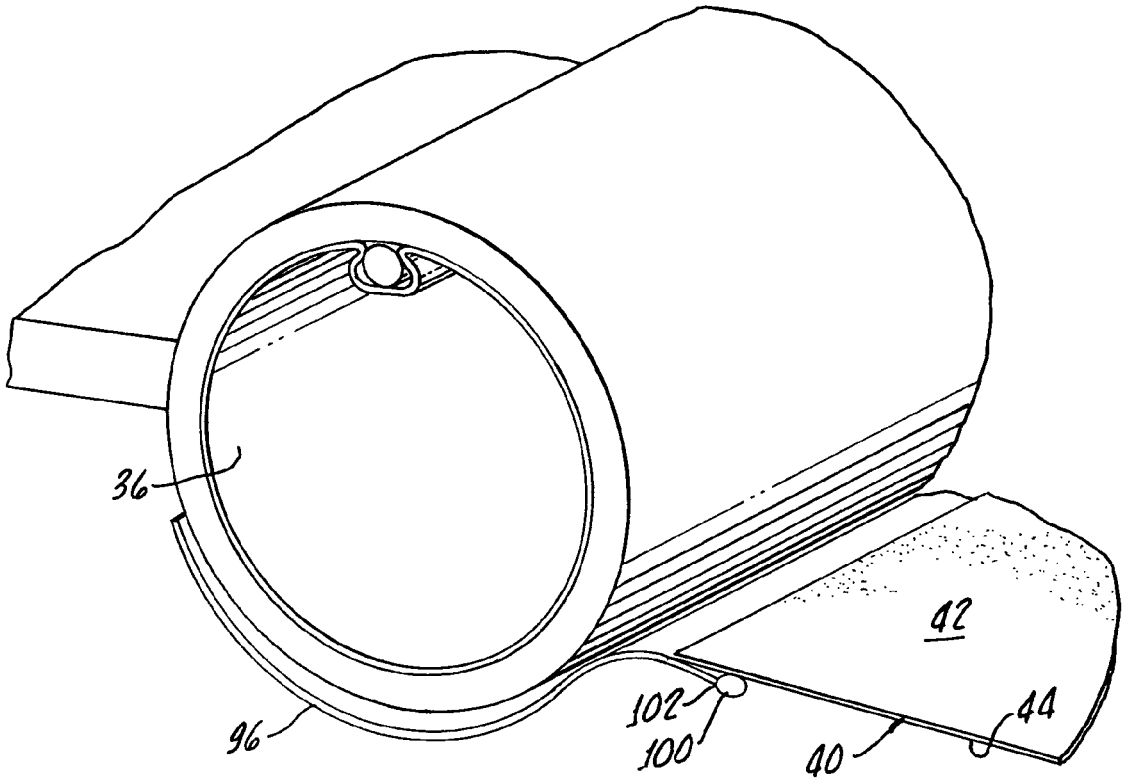
FIG. 5 is an enlarged perspective view of the roller and fabric along with a fabric tray.

A motorized roller 36 shown as a tube in FIGS. 4 and 5 is disposed between the cantilevered portion 28 and a roof 14 and the gap 30 as most clearly seen in FIG. 4. This arrangement, as hereinabove noted, allows for a much lower profile for the awning system 10. The roller may be conventionally powered as, for example, as set forth in U.S. Pat. No. 6,782,936 to Girard. This reference patent is incorporated herewith in its entirety to illustrate the type of roller 36 which may be suitable for use in the present invention. A fabric 40 having a topside 42 and a bottom side 44 is wound on the roller 36 and extendable therefrom with an end 46 attached to a lead rail.

A plurality of first articulated arms, such as those described in U.S. Pat. No. 6,782,936 are provided, interconnecting corresponding arm supports 20 with the lead rail 50, for tensioning the fabric 40 between the roller 36 and lead rail 50.

A cover 58 shown in FIGS. 1 and 2 encloses the arm supports 20, roller 36, and fabric 40 when wound on the roller 36.

Also, as shown in FIG. 1, a valance 62 may be provided and deployable from the lead rail 50 in a conventional manner.

While not discussed in detail in order to reduce redundancy, a second fabric 66 is deployable from the vehicle roof 14 via second arms 68, the fabric 66 being enclosed by a second cover 72.

As shown in FIG. 4, the arms 54 are hinged 76 mounted to the cantilever portion 28 of the arm support 20 and operate in a conventional manner.

Individual fairings 80, 82 may enclose ends 86, 88 of the covers 58, 66 respectively provide decorative coverings which enhance the cosmetics of the entire vehicle 16 and further reduce wind resistance.

Alternatively, a single faring 92 may interconnect the covers 58, 72 as illustrated in FIG. 2 for enhancing the cosmetics and wind resistant properties of the vehicle 16.

With reference again to FIG. 5, a fabric support tray 96 may be disposed under the roller with the fabric wound thereabout for guiding the fabric. In addition, a bottom fabric brush 100 may be disposed near an edge 102 of the tray 96 for removing debris and smoothing of the awning bottom 44. A top fabric brush 106, as shown in FIG. 4 provides for cleaning and smoothing of the awning topside 42.

Although not shown in the drawings, it should be appreciated that all wiring for the awning can be on the vehicle roof 14 with no need to feed wires through the roof 14 or sidewalls with the exception of a power line (not shown) since most functions including extending, retracting, valance 62 roll out retraction, lighting, and audio visual effects can be controlled by an operator.

Traditional environmental sensors and/or load and motion sensors may be incorporated to enable an automatic controller to determine whether the awning should be extended or retracted. In that regard, the externally mounted arm supports 20 are ideal locations for unobtrusive load sensors.

Although there has been hereinabove described a specific modular roof mount awning system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A vehicle awning system comprising:

a plurality of first arm supports disposable in a spaced apart relationship on a vehicle roof, each support having a cantilevered portion disposable in a spaced apart relationship with said vehicle roof;

a first roller disposed between said cantilevered portion and said vehicle roof;

a first lead rail;

a first fabric, having a top side and a bottom side, wound on said roller, extendable therefrom and having an end attached to said lead rail; and a plurality of first articulated arms interconnecting a corresponding arm support with said lead rail and disposed over the fabric top side for tensioning said fabric between said roller and said lead rail.

2. The awning system according to claim 1 further comprises a fabric support tray disposed under said roller.

3. The awning system according to claim 2 further comprises a bottom fabric brush disposed at an edge of said fabric support tray and engaging the fabric bottom side.

4. The awning system according to claim 3 further comprises a top fabric brush disposed over and engaging the fabric top side.

5. The system according to claim 1 further comprises a cover enclosing the arm supports and roller.

6. The awning system according to claim 5 further comprises an aerodynamic fairing disposable on ends of said cover.

7. The awning system in accordance to claim 6 wherein said cover, roller and fabric have a length approximately equal to a vehicle roof length.

8. The awning system according to claim 1 further comprising a valance deployable from said lead rail.

* * * * *